United States Patent [19]

Koike

[11] 4,443,777

[45] Apr. 17, 1984

[54] MINIATURE TRANSFORMER

[75] Inventor: Tsutomu Koike, Higashi-Murayama, Japan

[73] Assignee: Toku Kabushiki Kaisha, Tokyo, Japan

[21] Appl. No.: 311,440

[22] Filed: Oct. 14, 1981

[30] Foreign Application Priority Data

Oct. 15, 1980 [JP] Japan ..... 55-146576[U]
Oct. 15, 1980 [JP] Japan ..... 55-146577[U]

[51] Int. Cl.³ ..... H01F 15/02; H01F 27/30

[52] U.S. Cl. ..... 336/65; 336/192; 336/198

[58] Field of Search ..... 336/198, 208, 192, 65

[56] References Cited

U.S. PATENT DOCUMENTS 1,752,866 4/1930 Trombetta ..... 336/208
3,213,397 10/1965 Brovermen ..... 336/198 X
4,000,483 12/1976 Cook et al. ..... 336/192 X
4,075,590 2/1978 Foldes ..... 336/198 X

FOREIGN PATENT DOCUMENTS 2301519 10/1973 Fed. Rep. of Germany ..... 336/198
2500293 8/1976 Fed. Rep. of Germany ..... 336/198

*Primary Examiner*—Thomas J. Kozma

[57] ABSTRACT

A small-size transformer comprises an insulative bobbin having a pair of flanges and a hollow center portion on which an insulated tape wire is wound in layers. The center portion of the bobbin is stepped to accommodate a lead wire so that the tape wire is uniformly wound in parallel layers between innermost and outermost layers thereof. A pair of insulative side members each of U-shaped cross section is fitted to the flanges of the bobbin in positions adjacent the outermost winding layer. A core structure has outer arms received in slots of the side members and an inner or center arm accommodated within the hollow center portion of the bobbin. A base is detachably connected to the bobbin and formed with plural vertical slots to firmly secure tubular lead wires therewithin to serve as terminal pins for connection to an associated circuit.

4 Claims, 4 Drawing Figures

MINIATURE TRANSFORMER

BACKGROUND OF THE INVENTION

The present invention relates to a small-size or miniature transformer having a winding which includes an insulated tape wire formed by a plastic film and a tape conductor such as copper or aluminum foil secured thereto or positioned thereon.

It is conventional practice to use a tape wire for a miniature transformer in devices such as AC-DC converters or the like. The prior art small-size transformer is provided with a bobbin integrally formed with a base. Furthermore, in conventional practice, tubular lead wires secured to and extending from the tape wire are connected to terminal pins provided on the base for connection to an external circuit. As a result, this integral structure presents difficulty in automatically assembling the transformer elements since the base constitutes an obstacle to straight alignment of the lead wires with the terminal pins, requiring cumbersome manual shaping of the lead wires. Furthermore, since each tubular wire is of considerable diameter, it is very difficult to wrap them around the terminal pins through usual wrapping techniques. Therefore, the tubular lead wires must be reliably attached to the terminal pins using other techniques, requiring a special tool and adding complexity to the production process.

The insulated tape wire is wound in layers on the center portion of an insulative bobbin to form a coil, and tubular lead wires are electrically connected to the coiled tape wire. Therefore, a portion of the tape wire above the underlying tubular wire tends to bulge outwardly. This causes a tape conductor to be displaced from the center line of an insulative plastic film, so that the safety margin between the edges of the conductor and the insulative film is small. This safety margin tends to decrease as a function of distance away from the bobbin to such an extent that the transformer might fail to meet the rated insulation requirement. Therefore, the prior art has encountered difficulties in properly winding the tape wire in parallel layers to avoid such problems.

On the other hand, in accordance with conventional practice, the outer surface of the coiled tape wire is wrapped by an insulating tape so that the coil is insulated from the core structure. However, since the coiled tape wire partially bulges out due to the lead wire, an air gap is often created between a flange portion of the bobbin and an edge of the wrapped insulating tape, resulting in a possibility of a decrease in distance between the tape conductor of the tape wire and the core and hence a decrease in insulation. Therefore, difficulties have been encountered in safety standard requirements when subjected to high voltage.

SUMMARY OF THE INVENTION

Accordingly, an object of the invention is to provide a miniature transformer enabling the insulated tape wire to be wound easily onto the bobbin to permit automatic assembly of transformer elements.

Another object of the invention is to provide a miniature transformer eliminating terminal pins for connection of the lead wires.

A further object of the invention is to provide a miniature transformer preventing displacement of the flat conductor of the winding from the correct position due to connection to the tubular lead wires.

A still further object of the invention is to provide a miniature transformer which assures excellent insulation.

In order to achieve one or more of these objects the present invention contemplates separation of the bobbin from the base which are detachably engaged during assembly. The base is provided with plural vertical slots in which the tubular lead wires are inserted and held in position to serve as terminal pins. The center portion of the bobbin is stepped in a direction parallel to the longitudinal axis thereof to permit the tubular lead wire, which is connected to the innermost layer of the tape wire, to be accommodated in the stepped portion so that the tape wire is wound in parallel layers throughout between the innermost layer and the outermost layer.

BRIEF DESCRIPTION OF THE DRAWINGS

These and other objects, advantages and the features of the present invention will become apparent from the following detailed description which is given by way of example with reference to the drawings wherein.

DETAILED DESCRIPTION

Figure 1:
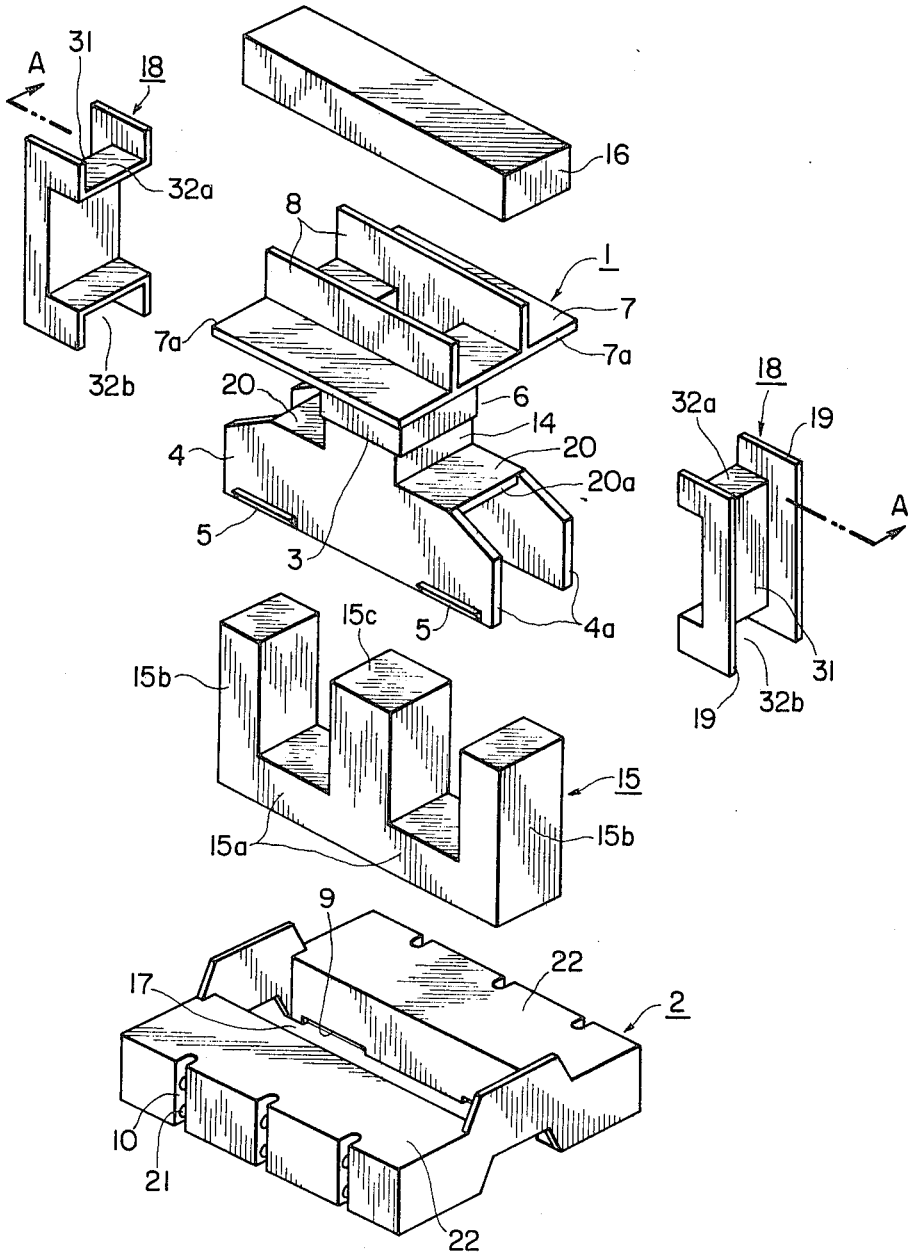
FIG. 1 is an exploded, perspective view of the miniature transformer of the present invention.
Figure 2:
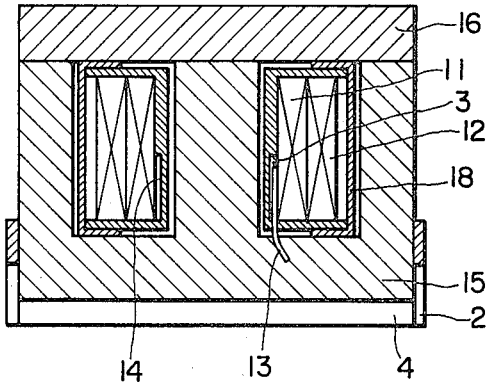
FIG. 2 is a cross-sectional view taken along the line A—A of FIG. 1.

Referring to FIGS. 1 and 2, a miniature transformer of the invention generally comprises an insulative bobbin 1 and insulative base 2 having an elongated opening 17 which a lower portion 4 of the bobbin detachably engages when assembled together. A pair of insulative covering members or side members 18 are fitted to opposite sides of bobbin 1 in a manner described, below. A core structure formed by an E-shaped core 15 and a bar core 16 is also provided.

Bobbin 1 comprises a hollow center portion 6 of rectangular cross-section around which an insulative tape wire is coiled. The center hollow structure 6 is stepped partially or entirely around the circumference thereof, at 3, by an amount preferably equal to the diameter of a tubular lead wire, to form a stepped portion 14 extending between upper and lower flanges 7 and 20. Lower flanges 20 form part of lower portion 4, the latter including a pair of elongated plates 4*a* each having detent lugs or stoppers 5 of triangular cross-section. Elongated plates 4*a* and lower flanges 20 are formed by bevelling the corner portions of a rectangular structure so that outer edges 20*a* of flanges 20 are offset inwardly from the outer edges of plates 4*a*. Upper flange 7 is of rectangular shape and formed with a pair of upstanding members or guides 8 extending the length of flange 7 between edges 7*a* which are vertically aligned with edges 20*a* of lower flanges 20.

Each covering member 18 has a generally U-shaped cross section and a pair of angled end portions. The angled end portions form horizontal slots 32*a* and 32*b*, and side plates 19 of each covering member 18 forming therebetween a vertical slot 31. The upper and lower limb portions of each covering member 18 are spaced apart a distance equal to the distance between the upper surface of flange 7 and the lower surface of flange 20.

Base 2 is formed with plural vertical slots 10 on opposite sides thereof, each slot having one or more lugs 21 for holding a tubular lead wire in position to serve as a terminal as described below. Base 2 is further formed with a plural recess 9 which lugs 5 of bobbin 1 engage when both members are fitted together.

An insulated tape wire is wound onto center portion 6 of bobbin 1 to form a primary winding 11 and subsequently a secondary winding 12 thereon (see FIG. 2). The width of the insulative film of this tape wire is substantially equal to the spacing between flanges 7 and 20. A tubular lead wire 13 is soldered to one end of the tape conductor of primary winding 11. Because of stepped portion 14, tubular lead wire 13 is accommodated therein to allow the overlying layers of the winding to lie in parallel form along the circumference of center portion 6. Although not shown in FIG. 2, to the other end of primary winding 11 and also to both ends of secondary winding 12 are soldered other tubular lead wires respectively so that each lead wire is positioned over stepped portion 14 while not overlying the underlying lead wire or wires. The disadvantages of the prior art transformer described above are thus eliminated. Since base 2 and bobbin 1 are separate structures, the tape wire can be easily wound around bobbin 1 prior to engagement with base 2.

After the primary and secondary windings are wound onto bobbin 1, side covering members 18 are fitted to bobbin so that their upper slots 32*a* form part of the space in which bar core 16 is received and lower slots 32*b* form part of the space in which lower portion 15*a* of E-shaped core 15 is accommodated. Vertical slots 31 of covering members 18 are positioned to respectively define spaces receiving side limbs or portions 15*b* of core 15.

The E-shaped core 15 can be assembled with the bobbin 1 by inserting the side limbs 15*b* of the core into the slots 31 of the insulative side covering members 18 and its center limb 15*c* into the hollow center portion 6 of the bobbin 1. A pair of identical magnetic circuits is thus formed by inserting the bar core 16 into the space defined by the upstanding members 8 and firmly engaging it into the aligned slots 32*a* of the side members 18 to make contact with the end of each limb of the E-shaped core 15. The bar core 16 and the E-shaped core 15 are secured to with each other by using suitable holding means such as metal bands or adhesive.

Therefore, the creeping distance between the flat conductor of the coil and the core structure is entirely rendered significantly longer than is possible with the prior art transformer. This arrangement meets the safety standards, or insulation requirements, of the transformer for use in a variety of applications.

Figure 3:
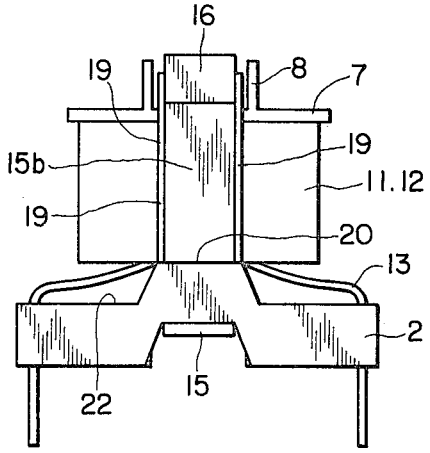
FIG. 3 is a side view of the transformer when assembled.
Figure 4:
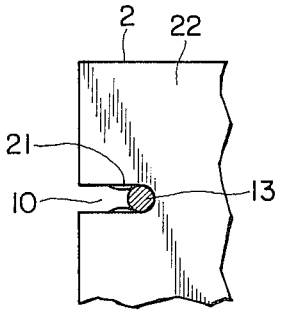
FIG. 4 is a view illustrating a tubular lead wire being firmly secured in a vertical slot of the base of FIG. 1.

The bobbin 1, now fitted with the core structure, is assembled with the base 2 by simply inserting the lower part 4 of the former into the opening 17 of the latter until the lugs 5 come into engagement with the recesses 9. Under this condition, the flange 20 of the bobbin 1 is located above the upper surface 22 of the base 2 as shown in FIG. 3 to leave a space therebetween so that tubular lead wires 13 extend into vertical slots 10 in which each lead wire is firmly secured between lugs 21 as shown in FIG. 4. This arrangement eliminates the need for terminals for electrical connection to an associated device.

The embodiment shown and described above is only a preferred form of the invention. Various modifications and alterations are apparent to those skilled in the art without departing from the scope of the invention which is only limited to the appended claims. For example, the center portion of the bobbin could be modified to have an annular cross-section. In the preferred embodiment shown, center portion 6 is stepped generally at a right angle, but is not necessarily limited to that angle. Furthermore, flange 7 can have a circular configuration with the cross section of slot 31 being accordingly modified. Also, elongated plates 4*a* can be modified to have stops or projections in the upper portions thereof. These stops or projections can contact with upper surfaces 22 when bobbin 1 fits into base 2, thus preventing further insertion of the bobbin into the base.

What is claimed is:

1. A miniature transformer comprising an insulative bobbin having a pair of flanges and a center portion around which an insulated tape wire is wound in layers, at least a part of said center portion being stepped in a direction parallel to the longitudinal axis of said bobbin to accommodate, in the stepped portion, a lead wire connected to the innermost layer of said tape wire.

2. A miniature transformer comprising a core structure having an inner part, a pair of outer parts, and lower and upper parts, an insulative bobbin having a hollow center portion into which the inner part of said core structure extends and around which an insulated tape wire is wound, said bobbin further having a pair of flanges between which extends said center portion, one of said flanges being provided with a pair of first opposed members forming an open-ended slot therebetween to accommodate the upper part of said core structure, the other flange being provided with a pair of second opposed members forming an open-ended slot therebetween to accommodate the lower part and a portion of each of the outer parts of said core structure, and a base detachably engageable with said second opposed members of the bobbin, wherein said base is formed with a plurality of elongated slots each including at least one projection for securing therein a portion of a lead wire which is connected to said tape wire to serve as a terminal pin.

3. A miniature transformer comprising a core structure having an inner part, a pair of outer parts, and lower and upper parts, an insulative bobbin having a hollow center portion into which the inner part of said core structure extends and around which an insulated tape wire is wound, said bobbin further having a pair of flanges between which extends said center portion, one of said flanges being provided with a pair of first opposed members forming an open-ended slot therebetween to accommodate the upper part of said core structure, the other flange being provided with a pair of second opposed members forming an open-ended slot therebetween to accommodate the lower part and a portion of each of the outer parts of said core structure, and a base detachably engageable with said second opposed members of the bobbin, wherein the center portion of said bobbin is stepped in a direction parallel to the longitudinal axis of said bobbin to accommodate, in the stepped portion, a lead wire connected to the innermost layer of said tape wire.

4. A miniature transformer comprising a core structure having an inner part, a pair of outer parts, and lower and upper parts, a bobbin having a hollow center portion into which the inner part of said core structure extends and around which an insulated tape wire is wound, said bobbin further including a pair of flanges between which extends said center portion, the center portion being stepped in a direction parallel to the longitudinal axis of said bobbin to accommodate, in the stepped portion, a lead wire connected to the innermost layer of said tape wire, one of said flanges being provided with a pair of first opposed members forming an open-ended slot therebetween to accommodate the upper part of said core structure, the other flange being provided with a pair of second opposed members having first engaging means and forming an open-ended slot therebetween to accommodate the lower part of said core structure, a base having second engaging means with which said second opposed members of the bobbin are detachably fitted through said first engaging means, and further including two insulative side members, each side member having a U-shaped cross section and a pair of angled end portions being oppositely positioned in a manner to hold said pair of flanges between the angled end portions, said outer parts of the core structure extending into the U-shaped portions of each insulative side member respectively, said base being formed with a plurality of elongated slots each including at least one projection for securing therein a portion of a lead wire connected to said tape wire to serve as a terminal pin for connection to an external circuit.

* * * * *

UNITED STATES PATENT AND TRADEMARK OFFICE

CERTIFICATE OF CORRECTION

PATENT NO. : 4,443,777

DATED : April 17, 1984

INVENTOR(S) : Tsutomu Koike

It is certified that error appears in the above-identified patent and that said Letters Patent is hereby corrected as shown below:

On page 1, item [73] (Assignee), "Toku" should read --Toko--

Signed and Sealed this

*Twenty-fifth* Day of *September 1984*

[SEAL]

*Attest:*

GERALD J. MOSSINGHOFF

*Attesting Officer*

*Commissioner of Patents and Trademarks*